US011501716B2

(12) United States Patent
An et al.

(10) Patent No.: US 11,501,716 B2
(45) Date of Patent: Nov. 15, 2022

(54) DISPLAY DEVICE INCLUDING SENSING UNIT FOR SENSING DETERIORATION INFORMATION OF DRIVING TRANSISTOR AND METHOD OF DRIVING THE SAME

(71) Applicant: SAMSUNG DISPLAY CO., LTD., Yongin-si (KR)

(72) Inventors: Bo Young An, Yongin-si (KR); Wook Lee, Yongin-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 0 days.

(21) Appl. No.: 17/121,097

(22) Filed: Dec. 14, 2020

(65) Prior Publication Data

US 2021/0287609 A1 Sep. 16, 2021

(30) Foreign Application Priority Data

Mar. 16, 2020 (KR) ..... 10-2020-0031997

(51) Int. Cl.
*G09G 3/3266* (2016.01)
*G09G 3/3291* (2016.01)

(52) U.S. Cl.
CPC ..... *G09G 3/3266* (2013.01); *G09G 3/3291* (2013.01); *G09G 2310/0278* (2013.01); *G09G 2310/0297* (2013.01); *G09G 2320/0233* (2013.01); *G09G 2320/0295* (2013.01);
(Continued)

(58) Field of Classification Search
CPC ... G09G 3/32–3291; G09G 2300/0426; G09G 2300/043; G09G 2300/0804; G09G 2300/0871; G09G 2310/0202; G09G 2310/0216; G09G 2310/0243; G09G 2310/0248; G09G 2310/0278; G09G 2310/0291; G09G 2310/0297; G09G 2310/066; G09G 2310/08; G09G 2320/04–045; G09G 2330/02;
(Continued)

(56) References Cited

U.S. PATENT DOCUMENTS 9,858,862 B2 1/2018 Kwon et al.
10,347,692 B2 7/2019 Lee et al.
(Continued)

FOREIGN PATENT DOCUMENTS

KR 101084236 B1 11/2011
KR 1020160058574 A 5/2016
(Continued)

*Primary Examiner* — Nathan Danielsen
(74) *Attorney, Agent, or Firm* — Cantor Colburn LLP

(57) ABSTRACT

A display device includes a display unit including a plurality of pixels and a sensing unit disposed outside the display unit, where the sensing unit senses deterioration information of a driving transistor in each of the pixels through a plurality of sensing lines, and compensates for deterioration of the driving transistor. the sensing unit senses the deterioration information during a first sensing period, and the first sensing period is included in each of a power-off period in which power for the display device to display an image is not supplied, a power-on period in which the display device is turned on, and an image display period in which the image is continuously displayed after the display device is turned on.

17 Claims, 12 Drawing Sheets

(52) U.S. Cl.
CPC . *G09G 2320/045* (2013.01); *G09G 2330/026* (2013.01); *G09G 2330/027* (2013.01)

(58) Field of Classification Search
CPC ..... G09G 2330/026; G09G 2330/027; G09G 2330/04; G09G 2330/10; G09G 2330/12
See application file for complete search history.

(56) References Cited

U.S. PATENT DOCUMENTS

| | | | | |
|---|---|---|---|---|
| 2010/0045650 | A1* | 2/2010 | Fish | G09G 3/3258 345/211 |
| 2011/0102410 | A1* | 5/2011 | Cho | G09G 3/3291 345/212 |
| 2011/0279444 | A1 | 11/2011 | Chung et al. | |
| 2014/0176516 | A1* | 6/2014 | Kim | G09G 3/3233 345/204 |
| 2014/0347332 | A1* | 11/2014 | Lee | G09G 3/3233 345/204 |
| 2015/0187271 | A1* | 7/2015 | Bae | G09G 3/3233 345/690 |
| 2016/0351095 | A1* | 12/2016 | Tani | G09G 3/3283 |
| 2017/0039953 | A1* | 2/2017 | Lee | G09G 3/3233 |
| 2017/0124949 | A1* | 5/2017 | Lee | G09G 3/3233 |
| 2017/0316735 | A1* | 11/2017 | Ohara | G09G 3/3233 |
| 2019/0147797 | A1* | 5/2019 | Yuan | G09G 3/3233 345/76 |

FOREIGN PATENT DOCUMENTS

| | | | |
|---|---|---|---|
| KR | 1020180045937 | A | 5/2018 |
| KR | 101993831 | B1 | 6/2019 |
| KR | 1020190067454 | A | 6/2019 |

* cited by examiner

DISPLAY DEVICE INCLUDING SENSING UNIT FOR SENSING DETERIORATION INFORMATION OF DRIVING TRANSISTOR AND METHOD OF DRIVING THE SAME

This application claims priority to Korean Patent Application No. 10-2020-0031997, filed on Mar. 16, 2020, and all the benefits accruing therefrom under 35 U.S.C. § 119, the content of which in its entirety is herein incorporated by reference.

BACKGROUND

1. Field

The disclosure relates to a display device and a method of driving the display device.

2. Description of the Related Art

A display device such as a conventional smart phone may include at least one display area. The display area may be defined by a data output part, and input data may be displayed on the display area. In addition, the display area may be provided with a touch sensor, and may be operated as a touch screen. Such a display area may be employed on a front surface of the display device to display various information.

Recently, a flat panel display device such as a liquid crystal display ("LCD"), a plasma display panel ("PDP"), or an organic light emitting display device, is widely used as a display device.

SUMMARY

In an organic light emitting display device, a pixel typically includes a plurality of transistors, a storage capacitor, and an organic light emitting diode ("OLED"). A difference of a luminance between the pixels may occur due to a deviation (for example, a distribution of threshold voltages of driving transistors) between the pixels, and a luminance difference may be recognized as a stain. Accordingly, a study for various stain compensation algorithms is being conducted to correct the stain.

An embodiment of the disclosure is to provide a display device in which a length of a period for sensing and compensating for deterioration of a driving transistor is minimized.

Another embodiment of the disclosure is to provide a display device and a method of driving the display device, which deterioration of a driving transistor is sensed or compensated, even in a period in which the display device is powered on or displaying an image.

An embodiment of a display device according to the disclosure includes a display unit including a plurality of pixels and a sensing unit disposed outside the display unit, where the sensing unit senses deterioration information of a driving transistor in each of the pixels through a plurality of sensing lines, and compensates for deterioration of the driving transistor. In such an embodiment, the sensing unit senses the deterioration information during a first sensing period, and the first sensing period is included in each of a power-off period in which power for the display device to display an image is not supplied, a power-on period in which the display device is turned on, and an image display period in which the image is continuously displayed after the display device is turned on.

In an embodiment, a length of the first sensing period may be in a range of about 10 microseconds (μs) to about 100 μs.

In an embodiment, the display device may further include a first scan driver which provides a scan signal to each of the pixels through a scan line, a second scan driver which provides a sensing scan signal to each of the pixels through a sensing scan line, and a data driver which provides a data voltage to each of the pixels through a data line.

In an embodiment, each of the pixels may include a first transistor which is the driving transistor, a second transistor connected between the data line and a gate electrode of the first transistor, where the second transistor may be turned on or off based on the scan signal, and a third transistor connected between one electrode of the first transistor and a corresponding one of the sensing lines, where the third transistor may be turned on or off based on the sensing scan signal, and the second transistor and the third transistor may be simultaneously turned on and off in the first sensing period.

In an embodiment, the sensing unit may include a multiplexer including a plurality of multiplexers including an input terminal connected to the sensing lines, and an analog-to-digital converter which performs an analog-digital conversion on a sensing signal received from the sensing lines to generate sensing data which is a digital signal.

In an embodiment, the sensing unit may further include an operational amplifier unit including a plurality of operational amplifiers connected between the multiplexer and the analog-to-digital converter.

In an embodiment, the number of the operational amplifiers included in the operational amplifier unit may be equal to or less than the number of the sensing lines.

In an embodiment, the operational amplifier unit may include a first operational amplifier and a second operational amplifier each of which integrates, samples, and scales a current flowing through the sensing lines, and differentially amplifies an output at one output terminal of the multiplexers, and a third operational amplifier including an inverting input terminal connected to another output terminal of each of the multiplexer, and a non-inverting input terminal to which an initialization voltage is provided.

In an embodiment, signals of two adjacent odd-numbered or even-numbered sensing lines may be input to the first operational amplifier and the second operational amplifier, and a signal of a sensing line between the two adjacent odd-numbered or even-numbered sensing lines may be input to the third operational amplifier.

In an embodiment, the display device may sense the deterioration information of the driving transistor during a second sensing period included in the power-off period, and a length of the second sensing period may be longer than a length of the first sensing period.

In an embodiment, the length of the second sensing period may be about 30 milliseconds (ms) or more.

In an embodiment, first to third compensation periods may be included in the power-off period, the power-on period, and the image display period, respectively, and the deterioration of the driving transistor may be compensated based on a sensing data value sensed in the second sensing period during the first to third compensation periods.

In an embodiment, the deterioration of the driving transistor may be further compensated during a fourth compensation period based on a first sensing data value sensed in the first sensing period included in the power-off period and a second sensing data value sensed in the first sensing period included in the power-on period.

In an embodiment, the deterioration of the driving transistor may be compensated during a fifth compensation period based on the first sensing data value sensed in the first sensing period included in the power-off period and a third sensing data value sensed in the first sensing period included in the image display period.

In an embodiment, the fifth compensation period may be included a plurality of times in the image display period, and in each of the fifth compensation periods, a threshold voltage of the driving transistor may be compensated in a step manner.

In an embodiment, the first sensing period included in the image display period may be included in a vertical blanking period in which image display is stopped.

An embodiment of a method of driving a display device with a power-off period in which power for displaying an image is not supplied, a power-on period in which the display device is turned on, and an image display period in which the image is continuously displayed after the display device is turned on, includes: sensing deterioration information of a driving transistor in a pixel of the display device during a first sensing period included in each of the power-off period, the power-on period, and the image display period; and compensating for deterioration of the driving transistor, based on a first sensing data value sensed in the first sensing period included in the power-off period and a second sensing data value sensed in the first sensing period included in the power-on period. In such an embodiment, a length of the first sensing period is in a range of about 10 μs to about 100 μs.

In an embodiment, the method may further include sensing the deterioration information of the driving transistor during a second sensing period included in the power-off period, where a length of the second sensing period is longer than a length of the first sensing period, and the second sensing period may be about 30 ms or more.

In an embodiment, the method may further include compensating for the deterioration of the driving transistor during each of the power-off period, the power-on period, and the image display period, based on a sensing data value sensed in the second sensing period.

In an embodiment, the method may further include compensating for the deterioration of the driving transistor, based on the first sensing data value sensed in the first sensing period included in the power-off period and a third sensing data value sensed in the first sensing period included in the image display period.

According to embodiments of the disclosure, the display device may minimize a length of a period in which the deterioration of the driving transistor is compensated.

In such embodiments, even though the deterioration of the driving transistor is sensed and compensated in a period in which the display device displays an image, recognition to the user may be minimized.

BRIEF DESCRIPTION OF THE DRAWINGS

The above and other features of the invention will become more apparent by describing in further detail embodiments thereof with reference to the accompanying drawings, in which.

DETAILED DESCRIPTION

Figure 1:
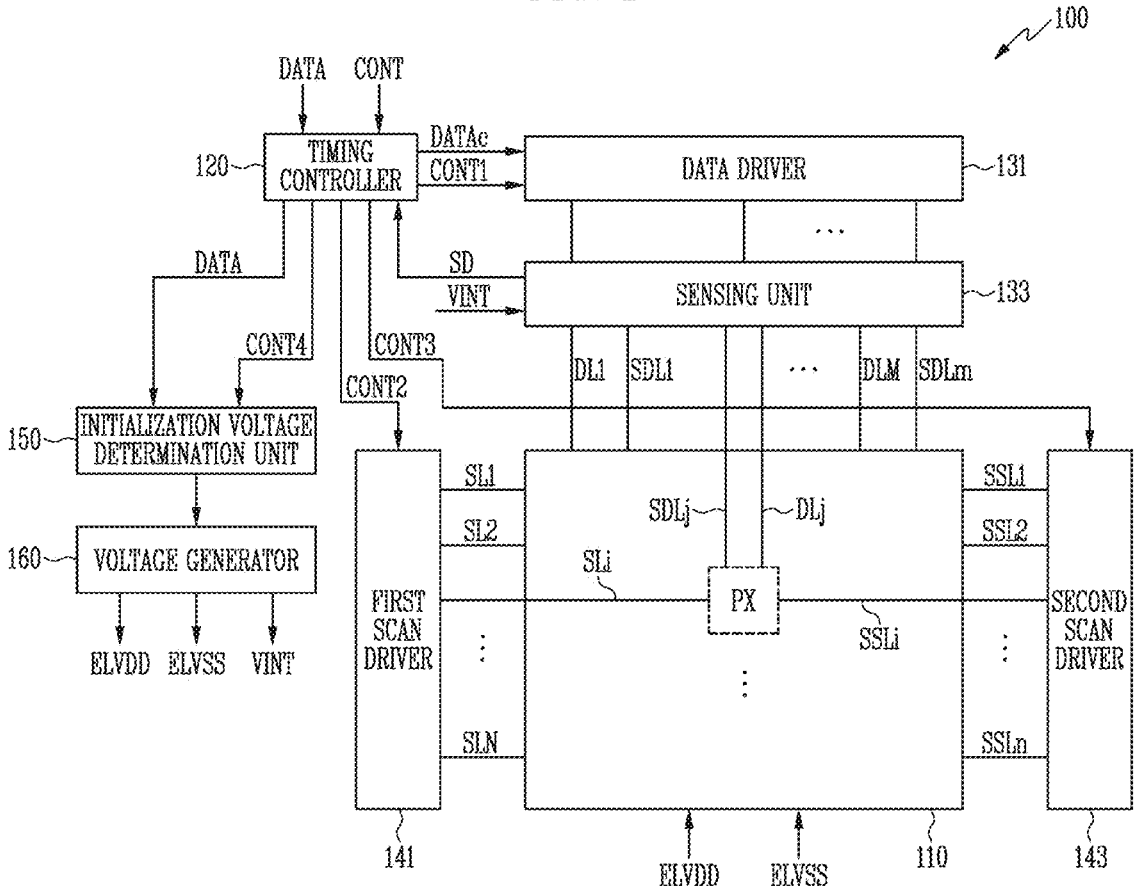
FIG. 1 is a block diagram of a display device according to an embodiment of the disclosure.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10% or 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, embodiments of the disclosure will be described in detail with reference to the accompanying drawings. The same or similar reference numerals are used to indicate the same or like components in the drawings.

A display device may include an organic light emitting display device, a quantum dot light emitting display device, a micro LED display device, and the like. Hereinafter, for convenience of description, embodiment where the display device is the organic light emitting display device will be described in detail. However, the disclosure is not limited thereto, and the spirit of the disclosure may be applied to other display devices as long as the spirit of the disclosure is not changed.

Figure 2:
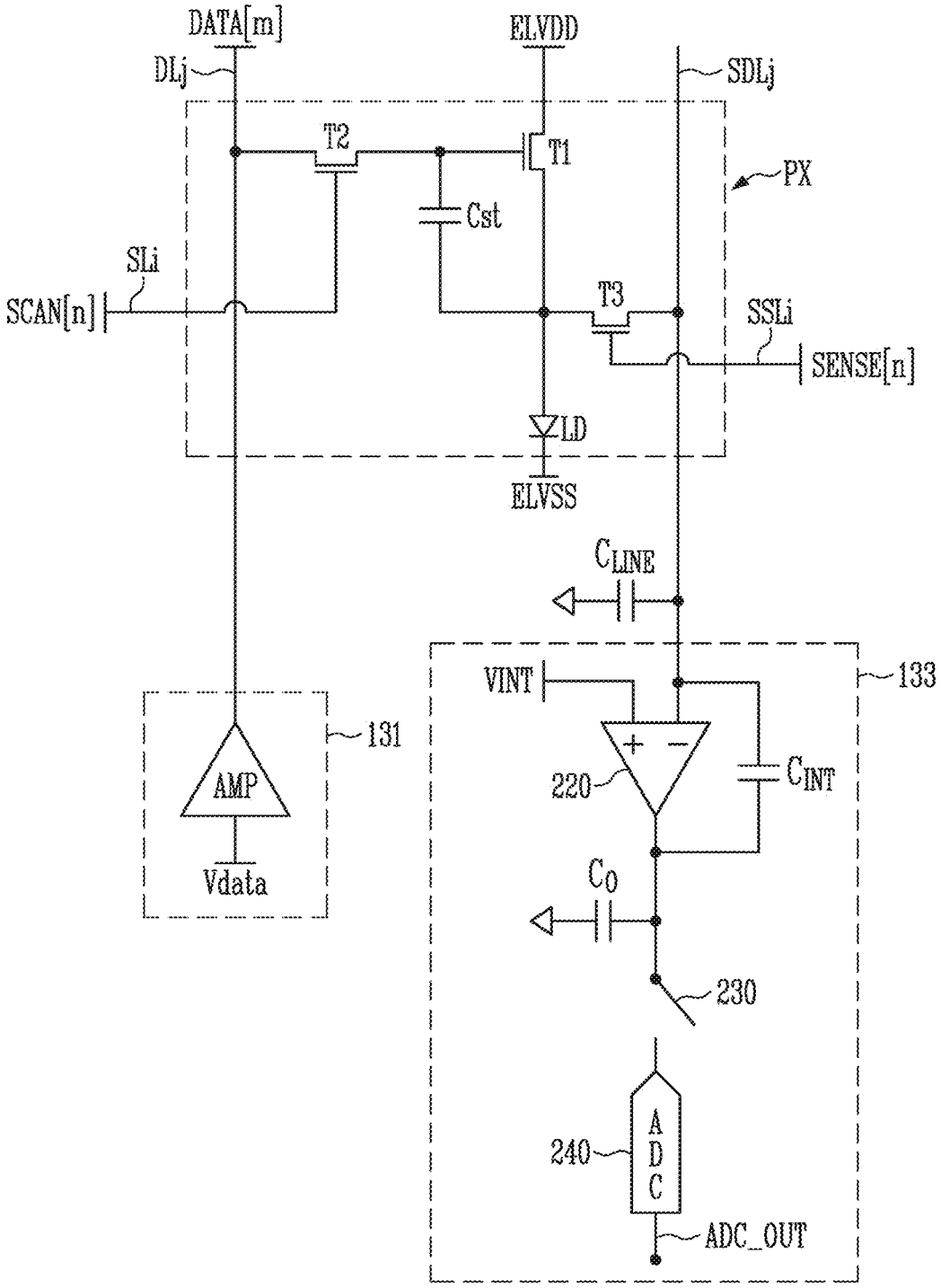
FIG. 2 is a circuit diagram showing a schematic connection relationship between a pixel, a data driver, and a sensing unit of FIG. 1.

FIG. 1 is a block diagram of a display device according to an embodiment of the disclosure. FIG. 2 is a circuit diagram showing a schematic connection relationship between a pixel, a data driver, and a sensing unit of FIG. 1.

Referring to FIGS. 1 and 2, an embodiment of the display device 100 includes a display unit 110, a timing controller 120, a data driver 131, a sensing unit 133, a first scan driver 141, and a second scan driver 143, an initialization voltage determination unit 150, and a voltage generator 160.

The display unit 110 includes a plurality of pixels PX, a plurality of scan lines SL1, SL2, and SLN, a plurality of sensing scan lines SSL1, SSL2, and g, a plurality of data lines DL1, DL2, and DLM, and a plurality of sensing lines SDL1, SDL2, and SDLm (here, n, N, m, and M are natural numbers).

The pixels PX may be arranged in a matrix form including a plurality of pixel rows and a plurality of pixel columns. The pixel row may correspond to a horizontal direction with respect to the display unit 110, and the pixel column may correspond to a vertical direction.

Each pixel PX includes a pixel circuit, and the pixel circuit includes a plurality of transistors and an organic light emitting diode driven by the plurality of transistors.

In one embodiment, for example, the pixel circuit includes a data line DLj, a sensing line SDLj, a scan line SLi, a sensing scan line SSLi, a first transistor T1, a light emitting element LD, and a second transistor T2, a storage capacitor Cst, and a third transistor T3 (here, j is a natural number equal to or greater than 1 and equal to or less than m and M, and i is a natural number equal to or greater than 1 and equal to or less than n and N).

The data line DLj is connected to an output terminal of the data driver 131 and transfers a data voltage Vdata or a data signal DATA[m] to the pixel circuit.

The sensing line SDLj is connected to the sensing unit 133. The sensing line SDLj may transfer an initialization voltage VINT to the pixel circuit in an image display period, and transfer a sensing signal generated in the pixel circuit to the sensing unit 133 in a sensing period. A line capacitor $C_{LINE}$ may be connected between a ground terminal and the sensing line SDLj.

The scan lines SL1, SL2, and SLN are connected to an output terminal of the first scan driver 141, and transfers a scan signal SCAN[n] generated by the first scan driver 141 to the pixel circuit. The scan signal SCAN[n] includes a period for turning on the second transistor T2.

The sensing scan lines SSL1, SSL2, and SSLn may be connected to an output terminal of the second scan driver 143, and transfers a sensing scan signal SENSE[n] generated by the second scan driver 143 to the pixel circuit. The sensing scan signal SENSE[n] includes a period for turning on the third transistor T3.

The first transistor T1 includes a gate electrode connected to the storage capacitor Cst, a first electrode that receives a first power voltage ELVDD, and a second electrode connected to an anode electrode of the light emitting element LD. The first transistor T1 may be referred to as a driving transistor.

The light emitting element LD includes the anode electrode connected to the second electrode of the first transistor T1 and a cathode electrode that receives a second power voltage ELVSS.

The second transistor T2 includes a gate electrode connected to the scan line SLi, a first electrode connected to the data line DLj, and a second electrode connected to the gate electrode of the first transistor T1. The second transistor T2 may provide the data voltage Vdata to the gate electrode of the first transistor T1 under control of the scan signal SCAN[n]. In such an embodiment, the second transistor T2 may be disposed between the data line DLj and the gate electrode of the first transistor T1, and may be turned on or off in response to the scan signal SCAN[n].

The storage capacitor Cst includes a first electrode connected to the gate electrode of the first transistor T1 and a second electrode connected the anode electrode of the light emitting element LD (the second electrode of the first transistor T1).

The third transistor T3 includes a gate electrode connected to the sensing scan line SSLi, a first electrode connected to the second electrode of the first transistor T1, and a second electrode connected to the sensing line SDLj. The third transistor T3 may provide information on a current flowing through the driving transistor or information on voltage of the anode electrode to the sensing unit 133 through the sensing line SDLj in response to the sensing scan signal SENSE[n]. The third transistor T3 may be connected between the second electrode of the driving transistor and the sensing line SDLj, and may be turned on or off in response to the sensing scan signal SENSE[n].

The timing controller 120 receives a control signal CONT and image data DATA from an outside, e.g., an external graphic device. The timing controller 120 generates a plurality of control signals based on the control signal CONT.

The plurality of control signals may include a first control signal CONT1 that controls the data driver 131, a second control signal CONT2 that controls the first scan driver 141, a third control signal CONT3 that controls the second scan driver 143, and a fourth control signal CONT4 that controls the initialization voltage determination unit 150.

The data driver 131 performs a digital-to-analog conversion on corrected image data DATAc provided from the timing controller 120 based on the first control signal CONT1 to generate the data voltage Vdata, and outputs the data voltage Vdata to a plurality of data lines DL1, DL2, and DLM.

The data driver 131 may include an amplifier AMP. The data driver 131 may output the data voltage Vdata to the data lines DL1, DL2, and DLM through the amplifier.

In an embodiment, the data driver 131 may output the data voltage Vdata for sensing the threshold voltage of the first transistor T1 in a corresponding pixel PX to the data lines DL1, DL2, and DLM.

The sensing unit 133 performs an analog-to-digital conversion on a sensing signal received from the plurality of sensing lines SDL1, SDL2, and SDLm to generate sensing data SD, which is a digital signal. The sensing unit 133 may provide the sensing data SD to the timing controller 120.

In an embodiment, the sensing unit 133 may be positioned outside the display unit 110. In one embodiment, for example, the sensing unit 133 may be provided in a form of a driver integrated circuit ("IC") together with the data driver 131 in the display device 100.

The sensing unit 133 may include an operational amplifier unit 220 including a first input terminal that receives the sensing signal and a second input terminal that receives an initialization voltage VINT, and output an analog signal to an output terminal.

The operational amplifier unit 220 may include an initialization capacitor $C_{INT}$ connected between the first input terminal and the output terminal. An output capacitor Co may be connected between a ground terminal and the output terminal of the operational amplifier unit 220.

The sensing unit 133 may include an analog-to-digital converter (also referred to as ADC) 240 that converts the sensing signal by an analog-to-digital conversion and outputs the sensing data to an output terminal ADC_OUT. The sensing unit 133 may include a switching member 230 (switching matrix which will be described later) connected between the output terminal of the operational amplifier unit 220 and the analog-to-digital converter 240. The sensing signal received from the sensing line SDLj may be output as the sensing data sequentially passing through the operational amplifier unit 220, the switching matrix 230, and the analog-to-digital converter 240.

Although not shown in the drawing, the sensing unit 133 may further include a multiplexer, which will be described later in detail with reference to FIG. 4 and the like.

According to an embodiment, the timing controller 120 calculates a correction value (for example, a threshold voltage compensation value of the driving transistor) to compensate for deterioration of the pixel circuit based on the sensing data, and generates the corrected image data DATAc based on the correction value.

According to an embodiment, the timing controller 120 may control the initialization voltage determination unit 150 to correct a level of the initialization voltage VINT based on the correction value.

The first scan driver 141 may generate a plurality of scan signals SCAN[n] based on the second control signal CONT2 and may sequentially output the plurality of scan signals SCAN[n] to the plurality of scan lines SL1, SL2, and SLN.

The second scan driver 143 may generate a plurality of sensing scan signals SENSE[n] based on the third control signal CONT3 and may sequentially output the plurality of sensing scan signals SENSE[n] to the plurality of sensing scan lines SSL1, SSL2, and SSLn.

In an embodiment, the first scan driver 141 and the second scan driver 143 may be separate units. In an alternative embodiment, a scan driver may be provided in the display device in a form of a single scan driver including a sub scan driver performing functions of each of the first scan driver 141 and the second scan driver 143.

According to an embodiment, a period in which the third transistor T3 is turned on by the sensing scan signal SENSE[n] applied to the pixel circuit may overlap a period in which the second transistor T2 is turned on by the scan signal SCAN[n].

The initialization voltage determination unit 150 divides the image data DATA of a frame into a plurality of blocks, and calculates a plurality of block luminance values in correspondence with the plurality of blocks.

The initialization voltage determination unit 150 extracts a maximum luminance value and a minimum luminance value among the plurality of block luminance values, and calculates a luminance difference value between the maximum luminance value and the minimum luminance value. The initialization voltage determination unit 150 determines the level of the initialization voltage VINT for each frame based on the luminance difference value.

The voltage generator 160 generates a plurality of driving voltages for driving the display 110 using an external power voltage. The plurality of driving voltages may include a first power voltage ELVDD, a second power voltage ELVSS, and a plurality of initialization voltages VINT.

According to an embodiment, the voltage generator 160 generates an initialization voltage VINT for each frame corresponding to the level of the initialization voltage VINT determined by the initialization voltage determination unit 150. The voltage generator 160 may output the initialization voltage VINT for each frame to the sensing unit 133.

Figure 3:
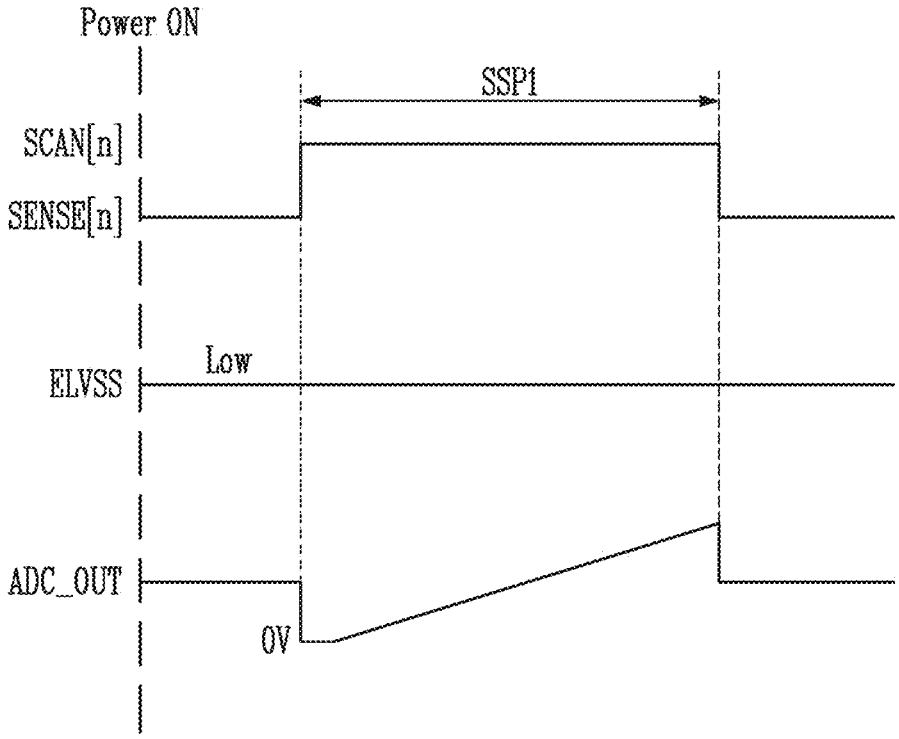
FIG. 3 is a timing diagram illustrating a method of driving a display device according to an embodiment of the disclosure.

FIG. 3 is a timing diagram illustrating a method of driving a display device according to an embodiment of the disclosure.

Referring to FIG. 3 together, in an embodiment of the method of driving a display device, the display device may have a power-off period in which power for displaying an image is not supplied, a power-on period in which the display device 100 is turned on by a user, and an image display period in which an image is continuously displayed after the display device 100 is turned on. FIG. 3 shows an embodiment where a sensing period is included in the power-on period among the above-described periods.

In an embodiment, the display device 100 may include a first sensing period SSP1 in at least one selected from the power-off period, the power-on period, and the image display period. In an embodiment, one or more first sensing periods SSP1 may be included in each of the at least one selected from the power-off period, the power-on period, and the image display period. In an embodiment, the first sensing period SSP1 may be included a plurality of times in the power-on period and/or the image display period.

In an embodiment, in the first sensing period SSP1, the data driver 131 may maintain a potential of the anode electrode of the light emitting element LD at a constant voltage through the amplifier, and the first scan driver 141 and the second scan driver 143 may supply the scan signal SCAN[n] and the sensing scan signal SENSE[n] of a gate-on level to the pixel circuit, respectively, to simultaneously turn on the second transistor T2 and the third transistor T3. At this time, the sensing unit 133 may sense a current by constant current driving. Here, the first sensing period SSP1 may be defined as a period for sensing deterioration information of the driving transistor in the pixel circuit.

Since the first sensing period SSP1 has a relatively short time, the threshold voltage of the driving transistor may be determined through the sensed current even though the first sensing period SSP1 is included in at least some period of the power-on period or the image display period. The first sensing period SSP1 may be referred to as a fast current sensing (fast U sensing ("FUSEN")) period.

In an embodiment, in the first sensing period SSP1, the scan signal and the sensing signal may be controlled to be the same as each other. Accordingly, a circuit configuration of the first scan driver 141 and the second scan driver 143 may be simplified compared to a conventional scan driver, and thus it may be desired in various aspects such as size and reliability. In such an embodiment, since the sensing unit 133 includes the operational amplifier, a length of the first sensing period SSP1 may be shortened compared to a length of the sensing time (second sensing period) performed in a conventional power-off period. In an embodiment, the length of the first sensing period SSP1 may be in a range of about 10 microseconds (μs) to about 100 μs. Accordingly, in an embodiment of the method of driving the display device 100, the display device 100 may sense deterioration of the first transistor in the power-on period or the image display period as well as the power-off period.

According to an embodiment, through the threshold voltage of the driving transistor determined in the first sensing period SSP1, a threshold voltage characteristic may be improved by varying a level of the initialization voltage VINT in the power-off period. In the power-on period or the image display period, display quality of the image recognized by the user may be improved through threshold voltage characteristic improvement (deterioration compensation) by varying the level of the initialization voltage based on a luminance characteristic of the image for each frame. The threshold voltage of the driving transistor may be improved by a characteristic of the initialization voltage provided to the driving transistor, and a period in which such an operation is performed may be defined as a compensation period. In an embodiment, the compensation period may be a period substantially equal to the first sensing period SSP1 (or the second sensing period), but is not limited thereto. In an alternative embodiment, the compensation period may be a period after the first sensing period SSP1 (or the second sensing period). The compensation period will be described later in greater detail with reference to FIG. 10.

According to an embodiment, the display device 100 may include the second sensing period in the power-off period. The second sensing period corresponds to a period in which the current is sensed by causing the driving transistor to be a source-follow form. In one embodiment, for example, in the second sensing period and the compensation period subsequent thereto, a process of inputting a black data voltage to the pixels PX, initializing, sensing, and then inputting the black data voltage again may be performed. In the second sensing period, the deterioration information of the driving transistor may be sensed similarly to the first sensing period SSP1. The second sensing period may have a length longer than the length of the first sensing period. In an embodiment, the second sensing period may have a length of about 30 milliseconds (ms) or more per pixel PX when considering a saturation time. In one embodiment, for example, where the display device 100 has an ultra-high definition ("UHD") resolution, the total length of the second sensing period for determining the threshold voltage of the driving transistor of all pixels PX may be in a range of about 5 minutes to about 10 minutes.

Hereinafter, a configuration of an embodiment of the sensing unit 133 for fast current sensing will be described.

Figure 4:
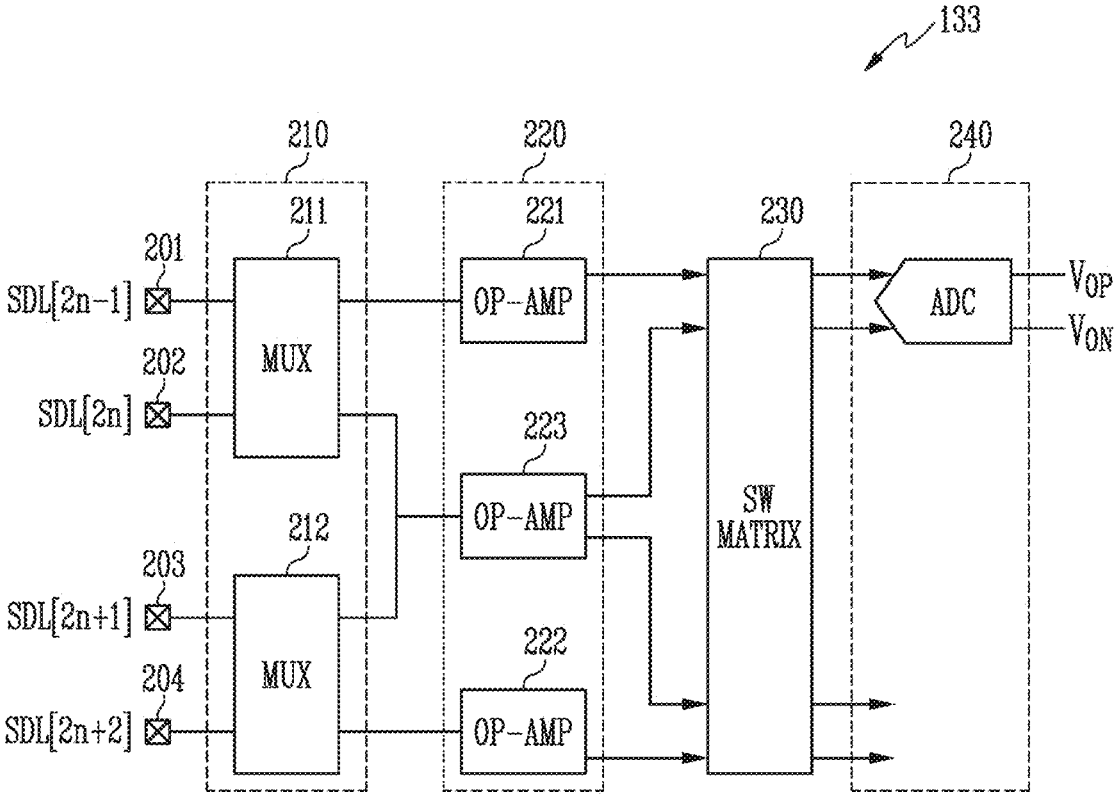
FIG. 4 is a block diagram schematically illustrating a part of a sensing unit according to an embodiment of the disclosure.
Figure 5:
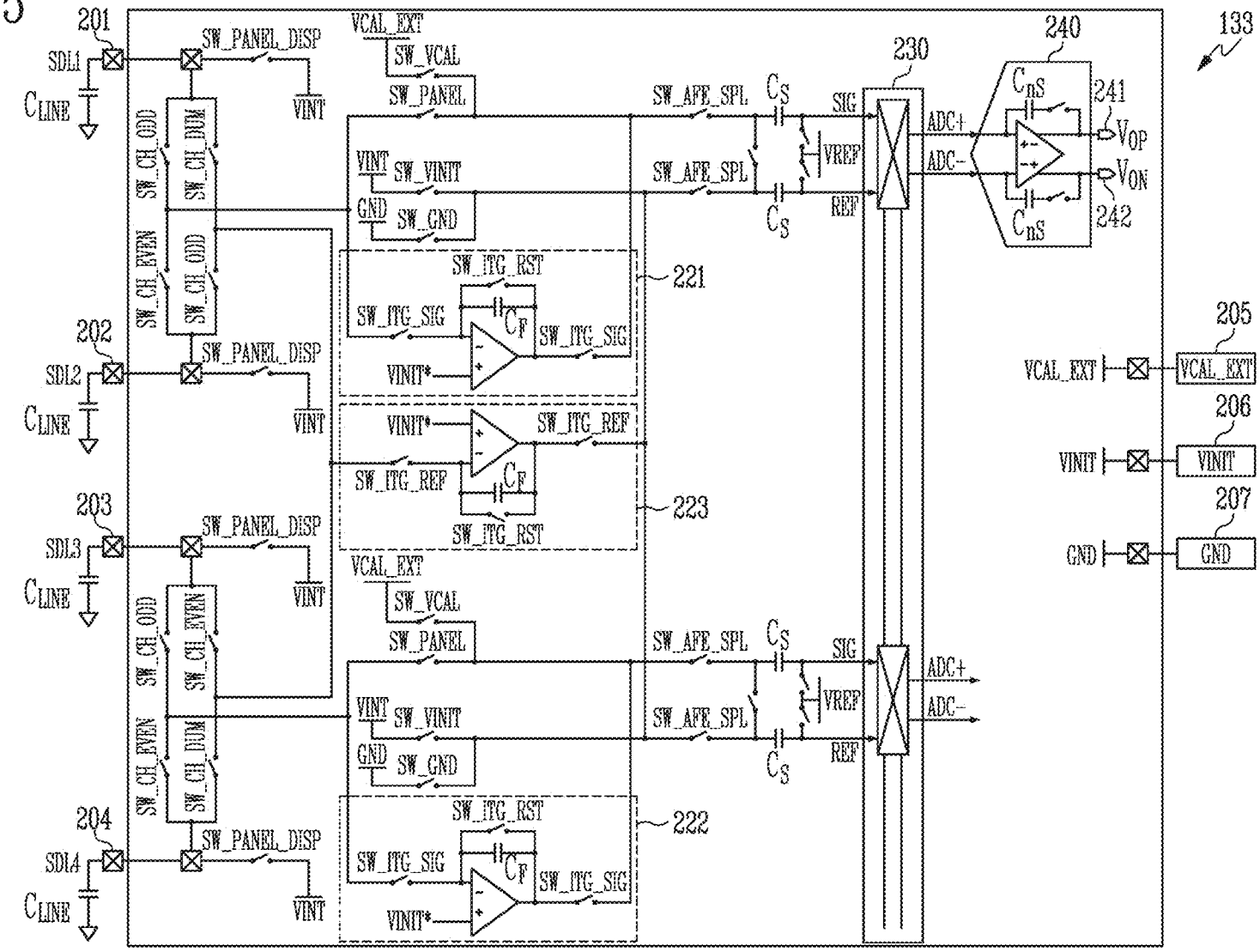
FIG. 5 is a circuit diagram of the sensing unit of FIG. 4.
Figure 6:
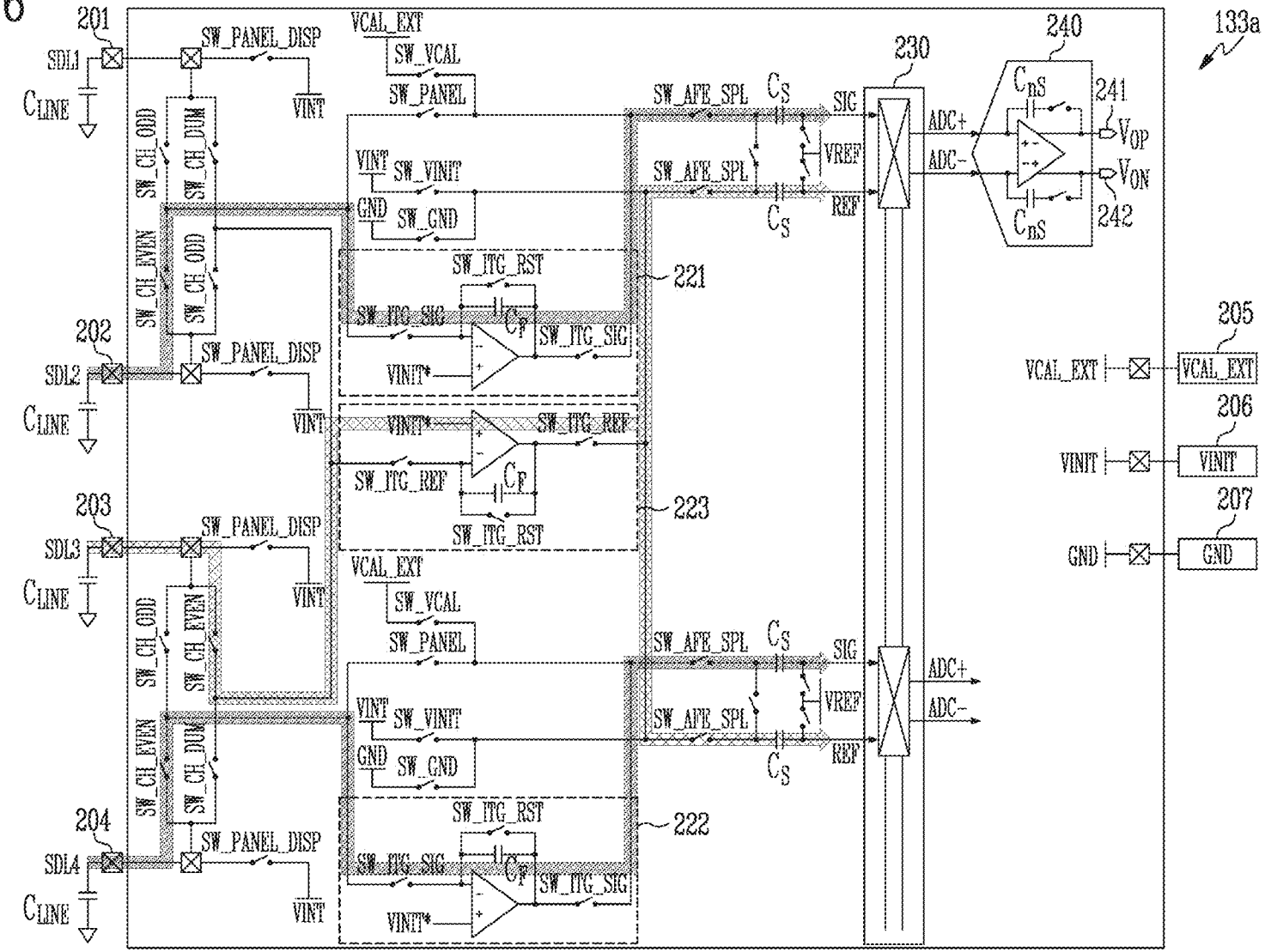
FIG. 6 is a conceptual diagram illustrating a schematic flow of a signal during an odd-numbered sensing line sensing period in the circuit diagram of FIG. 5.
Figure 7:
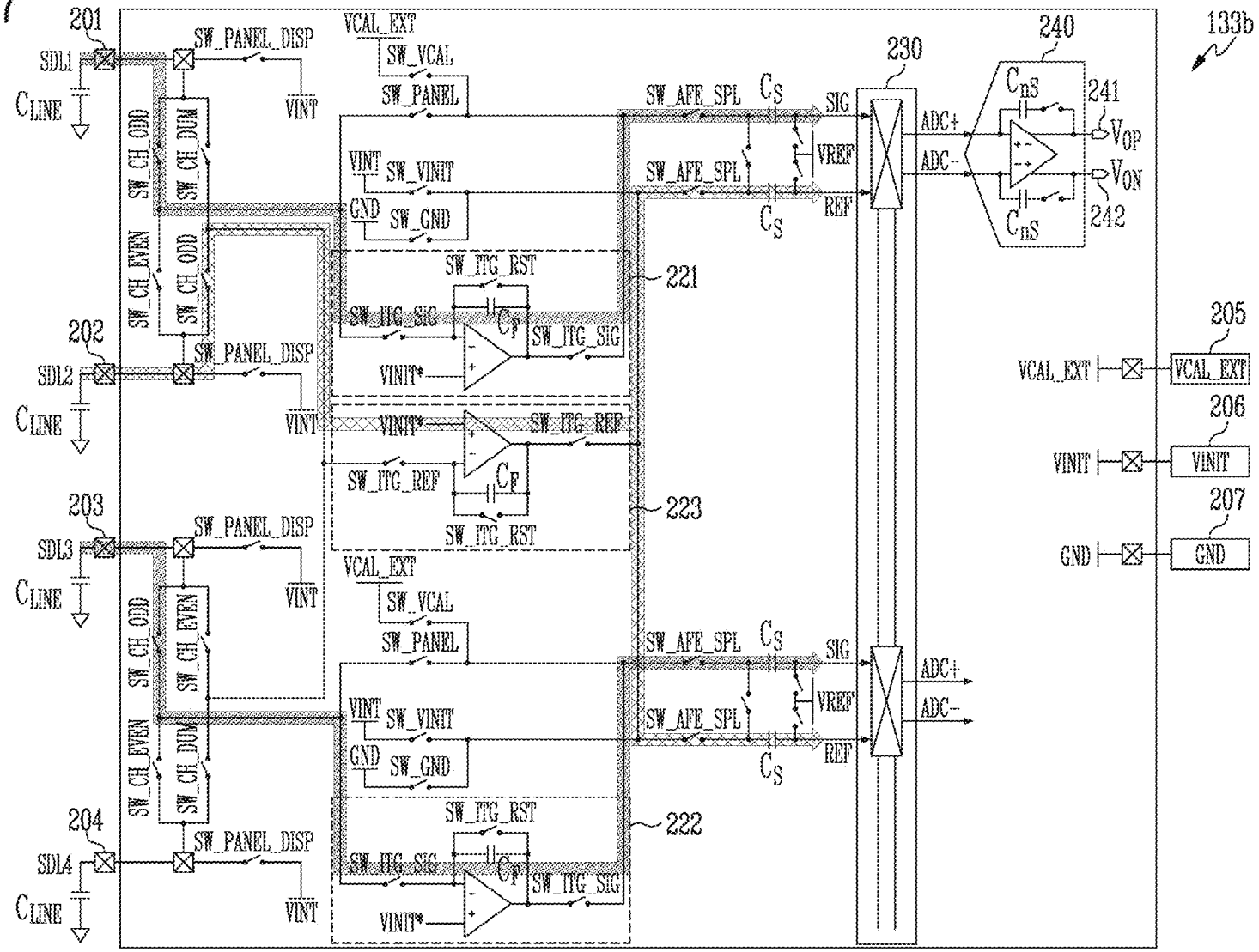
FIG. 7 is a conceptual diagram illustrating a schematic flow of a signal during an even-numbered sensing line sensing period in the circuit diagram of FIG. 5.

FIG. 4 is a block diagram schematically illustrating a part of the sensing unit according to an embodiment of the disclosure. FIG. 5 is a circuit diagram of the sensing unit of FIG. 4. FIG. 6 is a conceptual diagram illustrating a schematic flow of a signal during an odd-numbered sensing line sensing period in the circuit diagram of FIG. 5. FIG. 7 is a conceptual diagram illustrating a schematic flow of a signal during an even-numbered sensing line sensing period in the circuit diagram of FIG. 5.

FIGS. 4 to 7 show a part of the sensing unit 133 illustrating elements directly related to four sensing lines SDL[2*n*−1], SDL[2*n*], SDL[2*n*+1], and SDL[2*n*+2]) adjacently disposed. In addition, FIGS. 6 and 7 show the flow for describing the concept of a signal performed in the first sensing period SSP1.

Referring to FIGS. 4 to 7, an embodiment of the sensing unit 133 may include a multiplexer 210, an operational amplifier unit 220, a switch matrix 230, and an analog-to-digital converter 240.

According to an embodiment, the sensing unit 133 may include an input terminal electrically connected to a ground terminal 207 to which a ground potential GND is applied, an input terminal electrically connected to an initialization terminal 206 to which the initialization voltage VINT is applied, and an input terminal electrically connected to an external terminal 205 that supplies an arbitrary voltage VCAL_EXT to measure the sensing line. The sensing unit 133 may further include a plurality of switches SW_VCAL, SW_PANEL_DISP, SW_PANEL, SW_VINT and SW_GND to control application of voltages, e.g., the ground potential GND, the initialization voltage VINT and the arbitrary voltage VCAL_EXT thereto.

The multiplexer 210 may include a plurality of multiplexers 211 and 212. Input terminals of each of the plurality of multiplexers 211 and 212 are connected to at least one sensing line. Output terminals of each of the multiplexers 211 and 212 may be connected to one input terminal of the operational amplifiers (also referred to as OP-AMP) 221, 222, and 223.

In an embodiment, the input terminals of each of the multiplexers 211 and 212 may be connected to adjacent odd-numbered sensing lines SDL[2*n*−1] and SDL[2*n*+1]) and even-numbered sensing lines SDL[2*n*] and SDL[2*n*+2]. In the first sensing period SSP1, a sensing operation may be performed by dividing the first sensing period SSP1 into a first period (odd-numbered sensing line sensing period) and a second period (even-numbered sensing line sensing period) to differentially amplify a sensing values of the sensing lines. FIGS. 5 to 7 illustrate the multiplexers 211 and 212 connected to the first to fourth sensing lines SDL1, SDL2, SDL3, and SDL4 for convenience of description. In one embodiment, for example, input terminals 201 and 202 of the first multiplexer 211 may be connected to the first sensing line SDL1 which is one odd-numbered sensing line (for example, SDL[2*n*−1]) and the second sensing line SDL2 which is one even-numbered sensing line (for example, SDL[2*n*]). Input terminals 203 and 204 of the second multiplexer 212 may be connected to the third sensing line SDL3 which is another odd-numbered sensing line (for example, SDL[2*n*+1]) and the fourth sensing line SDL4 which is another even-numbered sensing line (for example, SDL[2*n*+2]).

In an embodiment, each of the multiplexers 211 and 212 may have a 2-to-1 multiplexer ("2:1 MUX") structure. Each of the multiplexers 211 and 212 may include a plurality of switching elements SW_CH_EVEN, SW_CH_ODD, SW_PANEL_DISP and SW_CH_DUM. The plurality of switching elements SW_CH_EVEN, SW_CH_ODD, SW_PANEL_DISP and SW_CH_DUM may include switching elements SW_CH_ODD turned on to sense the odd-numbered sensing lines SDL[2*n*−1] and SDL[2*n*+1] in the first period, switching elements SW_CH_EVEN turned on to sense the even-numbered sensing lines SDL[2*n*] and SDL[2*n*+2] in second period, and dummy switching elements SW_CH_DUM. According to an alternative embodiment, the dummy switching elements SW_CH_DUM may be omitted.

In an embodiment, the multiplexer 210 may implement a virtual switch matrix for every two sensing lines (for example, SDL1 and SDL2, and SDL3 and SDL4) as one unit to connect the sensing lines SDL1, SDL2, SDL3, and SDL4 and the operational amplifier unit 220 and to implement the 2:1 MUX structure.

The operational amplifier unit 220 may include a first operational amplifier 221 and a second operational amplifier 222 that integrate, sample, and scale a current flowing through the sensing lines SDL1, SDL2, SDL3, and SDL4, and differentially amplify an output of one output terminal of the multiplexers 211 and 212. The operational amplifier unit 220 may further include a third operational amplifier 223 through which an output of another output terminal of the multiplexers 211 and 212 are input. Each of the first to third operational amplifiers 221, 222 and 223 may include an amplifier, switches SW_ITG_SIG, SW_ITG_RST or SW_ITG_REF, and a capacitor $C_F$, as shown in FIG. 5.

The third operational amplifier 223 may integrate, sample, scale, and differentially amplify a current flowing through a reference sensing line. Here, the reference sensing line may be determined as the even-numbered sensing lines SDL[2*n*] and SDL[2*n*+2] in the first period for sensing the odd-numbered sensing lines SDL[2*n*−1] SDL[2*n*+1] and may be determined as the odd-numbered sensing lines SDL[2*n*−1] SDL[2*n*+1] in the second period for sensing the even-numbered sensing lines SDL[2*n*] and SDL[2*n*+2]. In one embodiment, for example, the reference sensing line during the first period may be set as the second sensing line SDL2, and the reference sensing line during the second period may be set as the third sensing line SDL3.

The third operational amplifier 223 may be a differential amplifier. An inverting input terminal of the differential amplifier may be connected to the other output terminal of the multiplexer through a switching element, and an initialization voltage VINT* may be provided to a non-inverting input terminal.

The third operational amplifier 223 may receive a signal from the reference sensing line. The third operational amplifier 223 may be configured identically or similarly to the first operational amplifier 221 and the second operational amplifier 222, and thus the third operational amplifier 223 may generate the reference signal REF equal to noise generated in the first operational amplifier 221 and the second operational amplifier 222. In an embodiment, a signal of a virtual ground voltage level may be provided to the reference sensing line. The reference signal REF generated from the third operational amplifier 223 may be transferred to the switch matrix 230 to offset the noise included in output terminals of the first operational amplifier 221 and the second operational amplifier 222.

In an embodiment, a differential signal may be transmitted to each of the reference sensing line and the even-numbered sensing lines SDL[2*n*] and SDL[2*n*+2]) or the odd-numbered sensing lines SDL[2*n*−1] and SDL[2*n*+1]) adjacent to the reference sensing line. The differential signals may be a signal transmitted through a transmission mode such as a double data rate three synchronous dynamic random-access memory ("DRAM") ("DDR3"), a low power double data rate synchronous DRAM ("LPDDR2"), low voltage differential signaling ("LVDS"), serial advanced technology attachment ("S-ATA"), and mobile industry processor interface ("MiPi").

In an embodiment, the number of the operational amplifiers 221, 222, and 223 included in the operational amplifier unit 220 may be equal to or less than the number of sensing lines SDL1, SDL2, SDL3, and SDL4. The display device 100 may include the operational amplifiers 221, 222, and 223 of the number less than that of the sensing lines SDL1, SDL2, SDL3, and SDL4 by disposing the multiplexer 210 between the plurality of operational amplifiers 221, 222, and 223 and the plurality of sensing lines SDL1, SDL2, SDL3, and SDL4.

The switch matrix 230 may selectively provide a signal SIG output from the operational amplifier unit 220 as voltages ADC+ and ADC− to the analog-to-digital converter 240 through switches SW_AFE_SPL and capacitors $C_S$.

In the first period (see 133*a* in FIG. 6), a current flowing through a source electrode of the driving transistor may be detected through the odd-numbered sensing lines SDL[2*n*−1] and SDL[2*n*+1] by applying the sensing data voltage Vdata to the pixel connected to the odd-numbered sensing lines SDL[2*n*−1] and SDL[2*n*+1]. The current flowing through the source electrode of the driving transistor may be detected through the even-numbered sensing lines SDL[2*n*] and SDL [2*n*+2] by applying the sensing data voltage Vdata for turning off the driving transistor to the pixel connected to the even-numbered sensing lines SDL[2*n*] and SDL [2*n*+2]. A value detected as described above may be differentially amplified and may be converted into a digital sensing value.

In the second period (see 133*b* in FIG. 8), the current flowing through the source electrode of the driving transistor may be detected through the even-numbered sensing lines SDL[2*n*] and SDL [2*n*+2] by applying the sensing data voltage Vdata to the pixel connected to the even-numbered sensing lines SDL[2*n*] and SDL [2*n*+2]. The current flowing through the source electrode of the driving transistor may be detected through the odd-numbered sensing lines SDL[2*n*−1] and SDL[2*n*+1] by applying the sensing data voltage Vdata for turning off the driving transistor to the pixel connected to the odd-numbered sensing lines SDL[2*n*−1] and SDL[2*n*+1]. A value detected as described above may be differentially amplified and may be converted into a digital sensing value.

In an embodiment, the analog-to-digital converter 240 may include a single analog-to-digital converter and capacitors $C_{nS}$, as shown in FIG. 5. However, the disclosure is not limited to the number of the analog-to-digital converter shown in FIG. 5. In an embodiment, where the sensing signal received from the plurality of sensing lines SDL1, SDL2, and SDLm are provided by the operational amplifier unit 220 and the switch matrix 230, the analog-to-digital converter 240 may perform analog-to-digital conversion on the sensing signal to generate sensing information data, which is a digital signal. The sensing unit 133 may provide the sensing information data output through the output terminals 241 and 242 of the analog-to-digital converter 240 to the timing controller 120. In one embodiment, for example, the sensing information data output through the output terminals 241 and 242 of the analog-to-digital converter 240 may have opposite bits $V_{ON}$ and $V_{OP}$. The timing controller 120 may extract sensing data SD based on the sensing information data.

Figure 8:
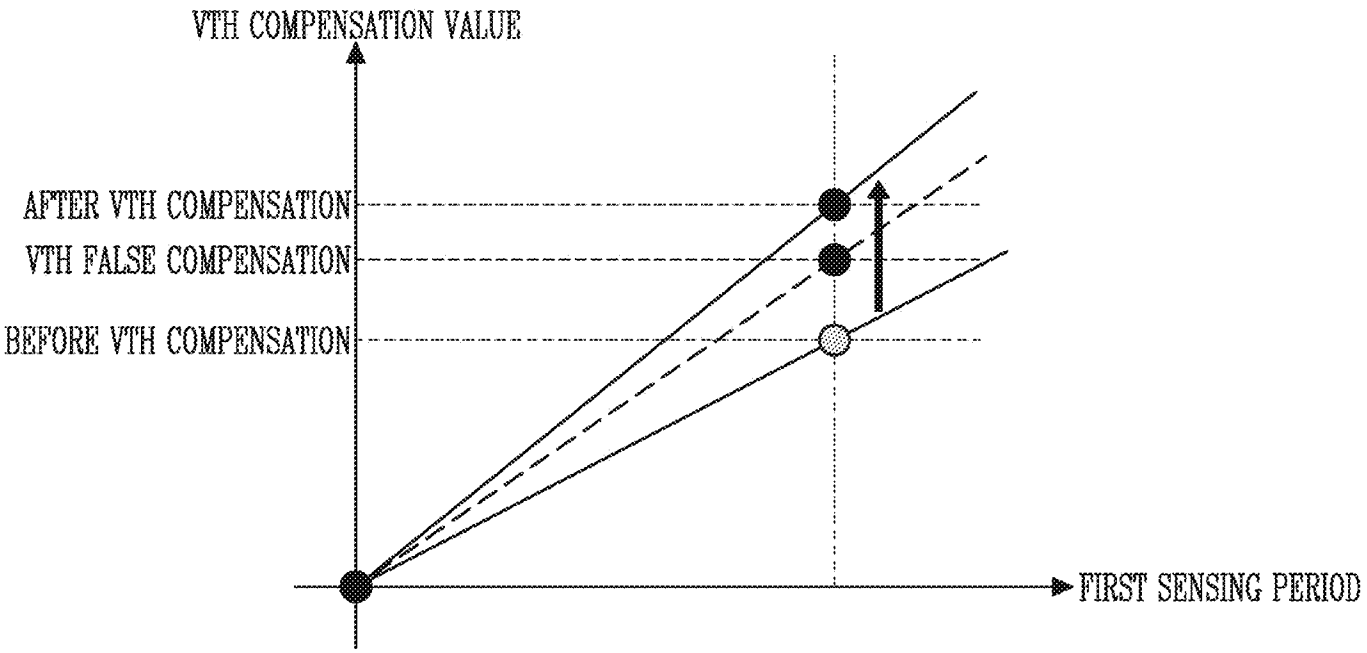
FIG. 8 is a graph schematically illustrating a threshold voltage compensation value of a driving transistor versus a time in a first sensing period in a pixel circuit according to an embodiment of the disclosure.

FIG. 8 is a graph schematically illustrating a threshold voltage compensation value of the driving transistor versus a time in the first sensing period in the pixel circuit according to an embodiment of the disclosure.

In FIG. 8, since an X-axis is a period in which the first sensing period SSP1 and the compensation period are substantially the same as each other, the X-axis is denoted as a time within the first sensing period SSP1. In FIG. 8, the threshold voltage of the driving transistor is denoted as VTH.

Referring to FIG. 8, according to an embodiment, when the threshold voltage (for example, after VTH compensation) of the driving transistor is compensated, compensation may be performed relatively accurately compared to the threshold voltage (for example, before VTH compensation) or the threshold voltage (for example, VTH false compensation) of the driving transistor in which false compensation is performed.

When sensing data (for example, see Sensing Data of FIG. 9) is obtained under a same sensing condition (same external condition, same sensing voltage, and same sensing time), the obtained sensing data may be same when the threshold voltage of the driving transistor is not changed. When a change of the sensing condition occurs, this is due to a change of the threshold voltage, and thus an inverse operation on the threshold voltage to be compensated may be possible. In a state in which the same sensing condition is maintained, the threshold voltage to be compensated may be calculated through comparison of sensing data sensed at different time points, and the threshold voltage may be compensated of the driving transistor based on the calculated value.

For example, the false compensation may occur when a deterioration amount of the driving transistor according to a duration of a power-on state of the display device 100 is not reflected and the compensation is performed based on the sensing data measured in the power-off period of the display device 100. Alternatively, for example, when the compensation is performed based on the sensing data measured based on the sensing data measured in the power-off state, in a case where the display device 100 continues the power-off state for several periods, a fact that a threshold voltage characteristic recovered by itself without external compensation according to a time may not be reflected, and thus the false compensation may occur.

Figure 9:
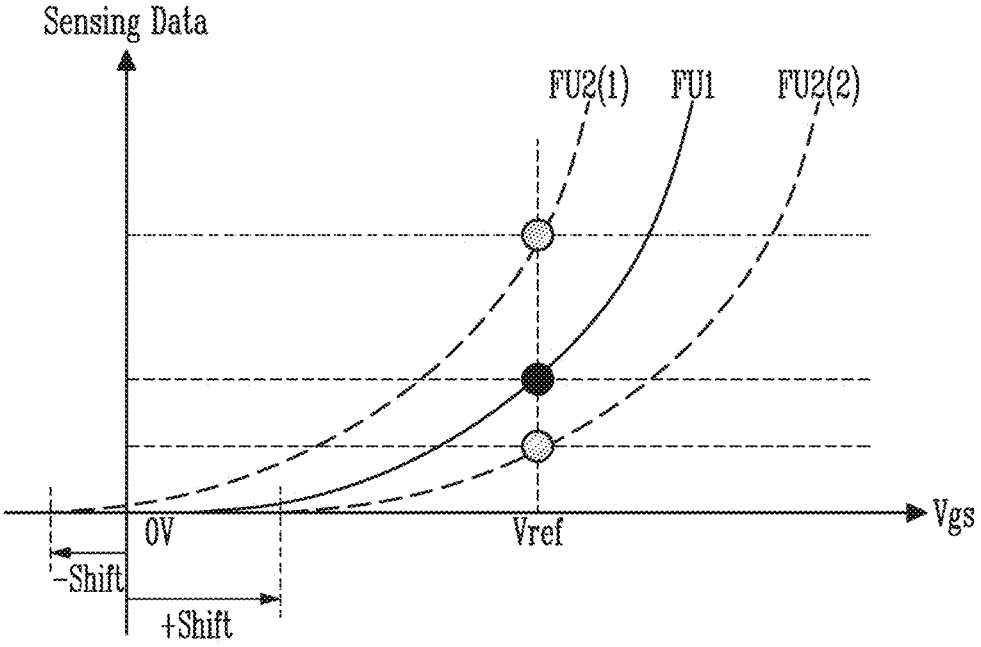
FIG. 9 is a graph related to a sensing data value according to a gate-source voltage of the driving transistor in the first sensing period according to an embodiment of the disclosure.
Figure 10:
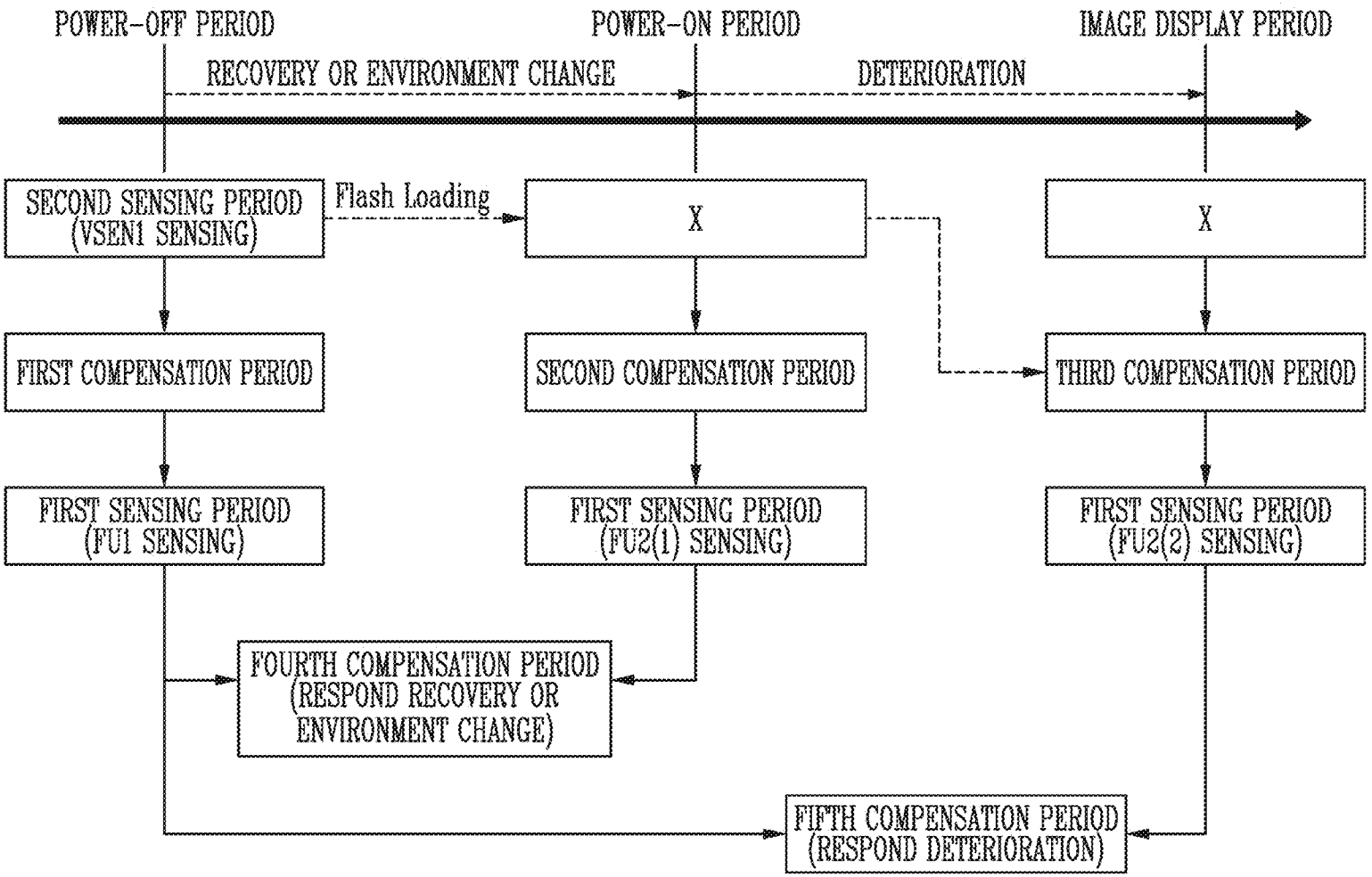
FIG. 10 is a conceptual diagram related to a method of compensating the threshold voltage of the driving transistor in the pixel circuit according to an embodiment of the disclosure.

FIG. 9 is a graph related to a sensing data value according to a gate-source voltage of the driving transistor in the first sensing period according to an embodiment of the disclosure. FIG. 10 is a conceptual diagram related to a method of compensating the threshold voltage of the driving transistor in the pixel circuit according to an embodiment of the disclosure.

Referring to FIG. 9, a first sensing data value FU1 is a value measured in the first sensing period SSP1 in the power-off state, a second sensing data value FU2(1) is a value measured in the first sensing period SSP1 after the power-off state continues, and a third sensing data value FU2(2) corresponds to a value measured in the first sensing period SSP1 after a certain time elapses in the image display period.

In a graph illustrating the first sensing data value FU1 in the power-off state, since a threshold voltage compensation of the driving transistor is completed, the a gate-source voltage of the driving transistor may pass 0 volt (V). After the power-off state is continued, in a graph illustrating the first sensing data value FU1, a value of a shifted threshold voltage may be reduced to be less than the threshold voltage compensation value due to recovery and the like. Therefore, the gate-source voltage of the driving transistor may be shifted in a negative direction (−shift in FIG. 9) than 0V. In a graph illustrating the third sensing data value FU2(2) after a certain time elapses in the image display period, the value of the threshold voltage shifted by additional deterioration progress becomes greater than the threshold voltage compensation value, and thus the gate-source voltage of the driving transistor may be shifted in a positive direction (+shift in FIG. 9) than 0V.

When a constant reference voltage Vref is applied to the driving transistor in the first sensing period SSP1 and the current is sensed, as the threshold voltage of the driving transistor according to an environment change of the display device 100 changes, the measured sensing value may be changed. In an embodiment, when the threshold voltage compensation value is applied by calculating a change amount of the threshold voltage with the sensing value of another first sensing period SSP1, the display device 100 may respond to a minute change of a threshold voltage in real time to compensate for such a change in the measured sensing value. Accordingly, the display device 100 may compensate for the threshold voltage of the driving transistor.

Referring to FIG. 10, in an embodiment, the power-off period may include the second sensing period, a first compensation period for compensating for the threshold voltage of the driving transistor based on a sensing value VSEN1, and the first sensing period SSP1. According to an embodiment, the first sensing period SSP1 of the power-off period may be included in the power-off state and/or when the power-off state is continued. The first sensing data value FU1 may be sensed in the first sensing period SSP1 in the power-off period.

According to an embodiment, the power-on period may include a second compensation period for compensating for the threshold voltage of the driving transistor in the power-on period based on the sensing data value VSEN1 in the second sensing period of the power-off period. In addition, the power-on period may further include the first sensing period SSP1 for measuring the second sensing data value FU2(1). As described above, the power-on period may not include the second sensing period.

According to an embodiment, the image display period may include a third compensation period for compensating for the threshold voltage of the driving transistor in the image display period based on the sensing data value VSEN1 in the second sensing period of the power-off period. As described above, the image display period may not include the second sensing period.

In an embodiment, the power-on period may include a fourth compensation period for calculating a compensation value and compensating for the threshold voltage to compensate for a change of the threshold voltage according to the recovery and/or the environment change. In the fourth compensation period, the compensation value may be calculated based on the first sensing data value FU1 and the second sensing data value FU2(1). According to an embodiment, the power-on period may include at least one fourth compensation period.

In an embodiment, the image display period may include a fifth compensation period for calculating the compensation value and compensating for the threshold voltage to compensate for the change of threshold voltage according to the deterioration. In the fifth compensation period, the compensation value may be calculated through the first sensing data value FU1 and the third sensing data value FU2(2). According to an embodiment, the image display period may include at least one fifth compensation period.

In an embodiment, the first sensing data value FU1 may be calculated based on Equation 1 below. In such an embodiment, the second sensing data value FU2(1) and the third sensing data value FU2 (2) may be calculated based on Equation 2 below.

$$FU1=k*a*(Vref-Vth)^{gamma} \quad \text{[Equation 1]}$$

$$FU2=k*a*(Vref-Vth+b)^{gamma} \quad \text{[Equation 2]}$$

In [Equation 1] and [Equation 2], k denotes a constant reflecting characteristics of the display device 100, a denotes a mobility component, Vref denotes the gate-source voltage of the driving transistor in the first sensing period SSP1, Vth denotes the threshold voltage of the driving transistor, gamma denotes a voltage-current conversion relationship, and b denotes an additional change amount of the threshold voltage. FU2 described in [Equation 2] denotes any one of the second sensing data value FU2(1) and the third sensing data value FU2(2). In one embodiment, for example, k, a, and gamma may have a same value between the pixels PX. In a case of FU1, since the first sensing period SSP1 of the power-off period is performed after the second sensing period, Vth may be 0 V.

The change value of the threshold voltage in the fourth compensation period and the fifth compensation period may be calculated through [Equation 1] and [Equation 2] as shown in [Equation 3] below.

$$b = Vref * \left( \left( \frac{FU2}{FU1} \right)^{\frac{1}{gamma}} - 1 \right) \quad \text{[Equation 3]}$$

FU1, and FU2 may be obtained using the first sensing data value FU1, the second sensing data value FU2, and the third sensing data value FU2(2), and gamma may be obtained using an I-V curve of the driving transistor. Accordingly, b may be a constant, and b corresponds to the value of the threshold voltage shifted as described above.

The compensation value calculated based on the sensing data value sensed in the second sensing period of the power-off period may be compensated in a form of over-compensation or un-compensation when a certain time elapses. However, the value of the threshold voltage shifted through the second sensing data value FU2(1) sensed in real time and the third sensing data value FU2(2) may be calculated, and the value of the threshold voltage may be added to the threshold voltage compensation value. Therefore, the display device 100 may become a structure in which the display device 100 may be compensated in real time.

In an embodiment, a real time current change amount may be sensed in the first sensing period SSP1 in the middle of the image display period through the operational amplifier unit 220 of the sensing unit 133. In such an embodiment, the value of the shifted threshold voltage may be calculated to compensate for the threshold voltage of the driving transistor in a real-time level.

Figure 11:
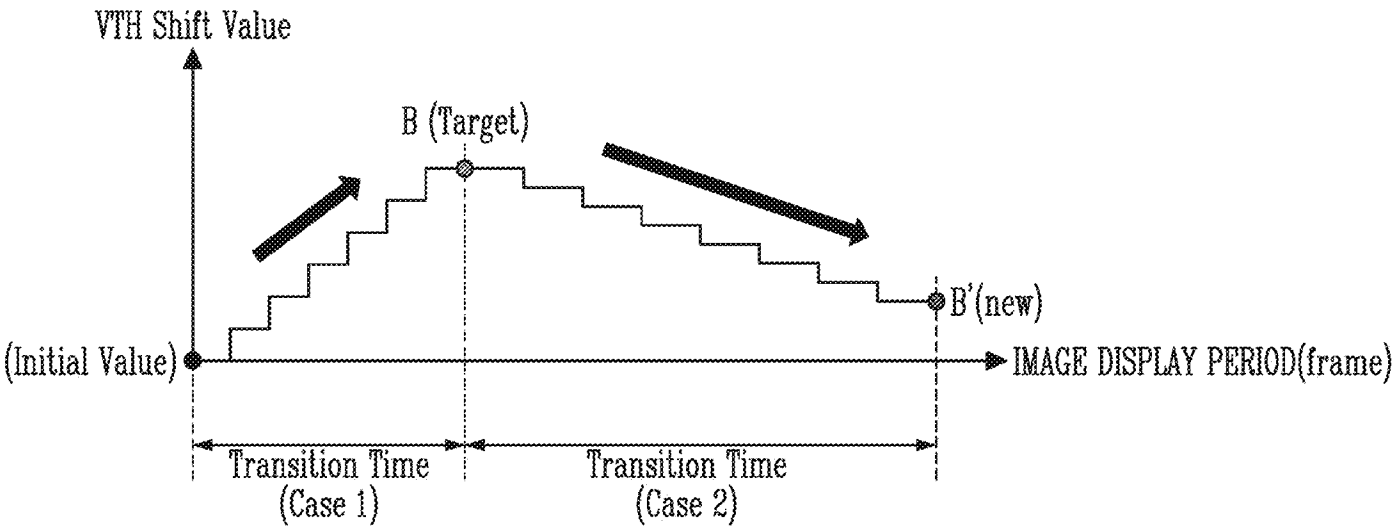
FIG. 11 is a graph illustrating that the threshold voltage of the driving transistor is compensated in an image display period according to an embodiment of the disclosure.

FIG. 11 is a graph illustrating that the threshold voltage of the driving transistor is compensated in the image display period according to an embodiment of the disclosure.

Referring to FIG. 11, the image display period may include a plurality of first sensing periods SSP1. The threshold voltage compensation value according to the value 'b' of the shifted threshold voltage may be applied in a step unit or in a step manner. That is, the image display period may include the plurality of first sensing periods SSP1 and the fifth compensation period according to each of the first sensing periods SSP1 to compensate for the threshold voltage in the step unit.

When the threshold voltage is compensated in the step unit, compensation performance may be improved such that compensation performed in the fifth compensation period in the image display period is natural. That is, even though the threshold voltage of the driving transistor is compensated in the fifth compensation period, recognition to the user may be minimized.

In one embodiment, for example, when the threshold voltage compensation value is set to B (target) according to the value 'b' of the threshold voltage shifted according to a predetermined first sensing period SSP1 in the image display period, a predetermined first period CASE1 may have a plurality of fifth compensation periods such that the threshold voltage reaches B (target) in the step unit. When the threshold voltage compensation value is set to B' (new) according to the value 'b' of the threshold voltage shifted according to a predetermined first sensing period SSP1 during a second period CASE2 after the first period CASE1, the predetermined second period CASE2 may have a plurality of fifth compensation periods such that the threshold voltage reaches B' (new) in the step unit.

Figure 12:
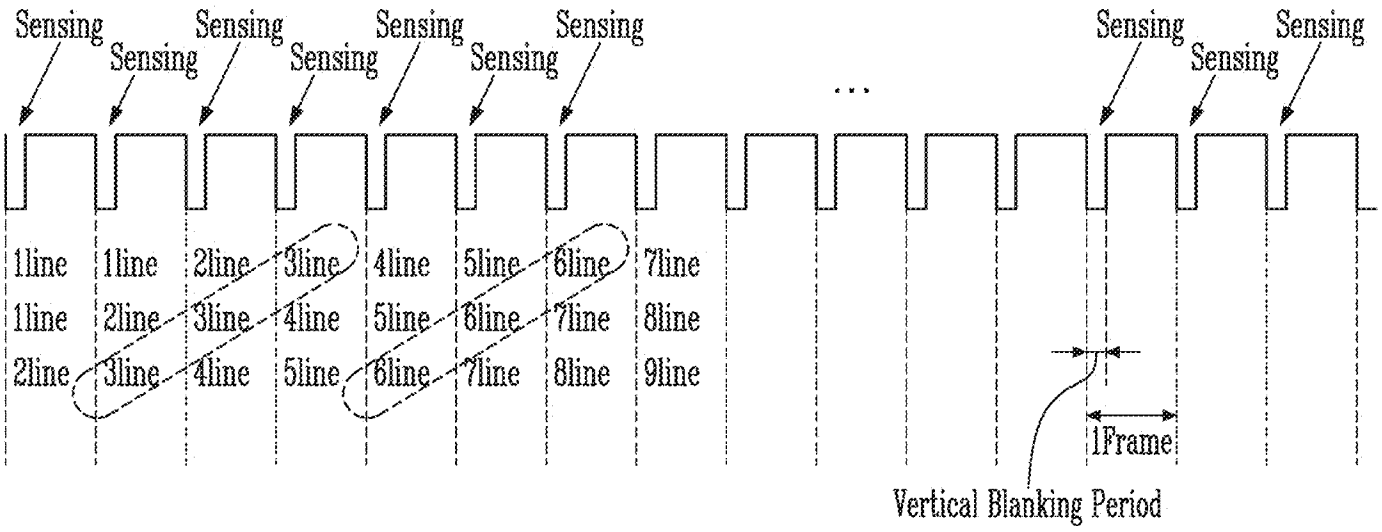
FIG. 12 is a graph illustrating a concept of the first sensing period according to an embodiment of the disclosure.

FIG. 12 is a graph illustrating a concept of the first sensing period according to an embodiment of the disclosure.

Referring to FIG. 12, in an embodiment, since the first sensing period is a relatively short time, the display device 100 may simultaneously sense the pixels PX connected to a plurality of sensing lines, in the first sensing period. The first sensing period in the image display period may be included in a vertical blanking period in which actual image display is stopped.

In one embodiment, for example, when the sensing unit 133 of the display device 100 simultaneously senses the pixels PX connected to three sensing lines as shown in FIG. 12, sensing data obtained by sensing the pixels PX connected to a same sensing line over three consecutive frames may be obtained. The sensing unit 133 of the display device 100 may obtain sensing data corresponding to the number of the frames including the first sensing period SSP1 with respect to the pixels PX connected to the same sensing line. In one embodiment, for example, when the sensing data are obtained over the three consecutive frames, the number of the obtained sensing data is three.

In an embodiment, the display device 100 may compensate for the threshold voltage based on an average value of the sensing data obtained for each of the pixels PX connected to the same sensing line. Accordingly, the false compensation according to noise outside the pixels PX and a sudden environment change may be minimized.

The graph shown in FIG. 12 is merely exemplary, and the number of sensing lines sensed in one vertical blanking period and the number of times of repeat sensing for each frame may be selectively preset or modified for each display device 100 according to an environment of the display device 100. Such setting value may be stored in a memory (not shown) in the display device 100.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display device comprising:

a display unit including a plurality of pixels; and a sensing unit disposed outside the display unit, wherein the sensing unit senses deterioration information of a driving transistor in each of the pixels through a plurality of sensing lines, and compensates for deterioration of the driving transistor, wherein the sensing unit senses the deterioration information during a first sensing period, the first sensing period is included in each of a power-off period in which power for the display device to display an image is not supplied, a power-on period in which the display device is turned on, and an image display period in which the image is continuously displayed after the display device is turned on, the display device senses the deterioration information of the driving transistor during a second sensing period included in the power-off period, the first sensing period included in the power-off period is after the second sensing period included in the power-off period, a length of the second sensing period is longer than a length of the first sensing period, and wherein first to third compensation periods are included in the power-off period, the power-on period, and the image display period, respectively, and the deterioration of the driving transistor is compensated based on a sensing data value sensed in the second sensing period during the first to third compensation periods.

2. The display device according to claim 1, wherein the length of the first sensing period is in a range of about 10 μs to about 100 μs.

3. The display device according to claim 1, further comprising:

a first scan driver which provides a scan signal to each of the pixels through a scan line;

a second scan driver which provides a sensing scan signal to each of the pixels through a sensing scan line; and a data driver which provides a data voltage to each of the pixels through a data line.

4. The display device according to claim 3, wherein each of the pixels comprises:

a first transistor which is the driving transistor;

a second transistor connected between the data line and a gate electrode of the first transistor, wherein the second transistor is turned on or off based on the scan signal; and a third transistor connected between one electrode of the first transistor and a corresponding one of the sensing lines, wherein the third transistor is turned on or off based on the sensing scan signal, and the second transistor and the third transistor are simultaneously turned on and off in the first sensing period.

5. The display device according to claim 1, wherein the sensing unit comprises:

a multiplexer including a plurality of multiplexers including an input terminal connected to the sensing lines; and an analog-to-digital converter which performs an analog-digital conversion on a sensing signal received from the sensing lines to generate sensing data which is a digital signal.

6. The display device according to claim 5, wherein the sensing unit further comprises an operational amplifier unit including a plurality of operational amplifiers connected between the multiplexer and the analog-to-digital converter.

7. The display device according to claim 6, wherein the number of the operational amplifiers included in the operational amplifier unit is equal to or less than the number of the sensing lines.

8. The display device according to claim 6, wherein the operational amplifier unit comprises:

a first operational amplifier and a second operational amplifier, each of which integrates, samples, and scales a current flowing through the sensing lines, and differentially amplifies an output at one output terminal of the multiplexers; and a third operational amplifier including an inverting input terminal connected to another output terminal of each of the multiplexer, and a non-inverting input terminal to which an initialization voltage is provided.

9. The display device according to claim 8, wherein signals of two adjacent odd-numbered or even-numbered sensing lines are input to the first operational amplifier and the second operational amplifier, and a signal of a sensing line between the two adjacent odd-numbered or even-numbered sensing lines is input to the third operational amplifier.

10. The display device according to claim 1, wherein the length of the second sensing period is about 30 ms or more.

11. The display device according to claim 1, wherein the deterioration of the driving transistor is compensated during a fourth compensation period based on a first sensing data value sensed in the first sensing period included in the power-off period and a second sensing data value sensed in the first sensing period included in the power-on period.

12. The display device according to claim 11, wherein the deterioration of the driving transistor is compensated during a fifth compensation period based on the first sensing data value sensed in the first sensing period included in the power-off period and a third sensing data value sensed in the first sensing period included in the image display period.

13. The display device according to claim 12, wherein the fifth compensation period is included a plurality of times in the image display period, and in each of the fifth compensation periods, a threshold voltage of the driving transistor is compensated in a step manner.

14. The display device according to claim 1, wherein the first sensing period included in the image display period is included in a vertical blanking period in which image display is stopped.

15. A method of driving a display device with a power-off period in which power for displaying an image is not supplied, a power-on period in which the display device is turned on, and an image display period in which the image is continuously displayed after the display device is turned on, the method comprising:

sensing deterioration information of a driving transistor in a pixel of the display device during a first sensing period included in each of the power-off period, the power- on period, and the image display period;

compensating for deterioration of the driving transistor, based on a first sensing data value sensed in the first sensing period included in the power-off period and a second sensing data value sensed in the first sensing period included in the power-on period;

sensing the deterioration information of the driving transistor during a second sensing period included in the power-off period; and compensating for the deterioration of the driving transistor during each of the power-off period, the power-on period, and the image display period, based on a sensing data value sensed in the second sensing period, wherein a length of the first sensing period is in a range of about 10 μs to about 100 μs, and wherein a length of the second sensing period is longer than the length of the first sensing period.

16. The method according to claim 15, wherein the length of the second sensing period is about 30 ms or more.

17. The method according to claim 16, further comprising:

compensating for the deterioration of the driving transistor, based on the first sensing data value sensed in the first sensing period included in the power-off period and a third sensing data value sensed in the first sensing period included in the image display period.

* * * * *